US007631984B2

(12) United States Patent
Martin et al.

(10) Patent No.: US 7,631,984 B2
(45) Date of Patent: Dec. 15, 2009

(54) MODULAR FLASHLIGHT AND METHOD OF USE THEREFOR

(75) Inventors: Richard W. Martin, San Antonio, TX (US); Thomas J. Chadwell, San Antonio, TX (US); Philip W. Miller, Jr., Castroville, TX (US)

(73) Assignee: Lightstick Partners, LLC., San Antonio, TX (US)

( * ) Notice: Subject to any disclaimer, the term of this patent is extended or adjusted under 35 U.S.C. 154(b) by 0 days.

(21) Appl. No.: 11/895,105

(22) Filed: Aug. 23, 2007

(65) Prior Publication Data

US 2007/0291479 A1 Dec. 20, 2007

Related U.S. Application Data

(63) Continuation-in-part of application No. 11/257,612, filed on Oct. 25, 2005, now Pat. No. 7,309,147.

(51) Int. Cl.
*F21L 4/04* (2006.01)

(52) U.S. Cl. ..... 362/205; 362/373; 362/294; 362/206; 362/202

(58) Field of Classification Search ..... 362/294, 362/190, 206, 191, 202, 254, 373, 205; 315/247, 315/200 A
See application file for complete search history.

(56) References Cited

U.S. PATENT DOCUMENTS

| | | | | |
|---|---|---|---|---|
| 3,002,143 | A * | 9/1961 | Reuther | 322/36 |
| 4,151,583 | A * | 4/1979 | Miller | 362/205 |
| 4,988,889 | A * | 1/1991 | Oughton, Jr. | 307/66 |
| 5,197,796 | A * | 3/1993 | Moore | 362/202 |
| 5,272,606 | A * | 12/1993 | Blaney | 362/157 |
| 5,571,279 | A * | 11/1996 | Chiang | 362/198 |
| 5,586,819 | A | 12/1996 | Bamber et al. | 362/158 |
| 6,568,829 | B2 | 5/2003 | Garrity et al. | 362/171 |
| 6,652,116 | B2 * | 11/2003 | Dickinson | 362/202 |
| 6,827,468 | B2 * | 12/2004 | Galli | 362/294 |
| 7,008,084 | B2 * | 3/2006 | Galli | 362/373 |
| 7,097,323 | B2 * | 8/2006 | Puckett | 362/202 |
| 7,153,004 | B2 * | 12/2006 | Galli | 362/373 |
| 2004/0190286 | A1 * | 9/2004 | Chapman | 362/171 |

* cited by examiner

*Primary Examiner*—Sharon E Payne
(74) *Attorney, Agent, or Firm*—Christopher L. Makay

(57) ABSTRACT

A flashlight includes a flashlight head assembly that may be used with either one or two batteries. For use with one battery, a body receives a battery therein and the flashlight head assembly is secured to the body. For use with two batteries, an extension unit is secured to the body and the flashlight head assembly is secured to the extension unit. A switch assembly disposed in the body and electrically connected with the flashlight head assembly controls the delivery of power to the flashlight head assembly.

27 Claims, 7 Drawing Sheets

Front Views

Back Views

MODULAR FLASHLIGHT AND METHOD OF USE THEREFOR

CROSS-REFERENCE TO RELATED APPLICATION

This present application is a continuation-in part of application Ser. No. 11/257,612, which was filed Oct. 25, 2005 now U.S. Pat. No. 7,309,147. By this reference, the full disclosure of application Ser. No. 11/257,612 is incorporated herein as though now set forth in its entirety.

BACKGROUND OF THE INVENTION

1. Field of the Invention

The present invention relates to a flashlight and, more particularly, but not by way of limitation, to a modular flashlight and a method of use therefor.

2. Description of the Related Art

Different situations create scenarios where a variety of flashlight alternatives are necessary. For example, outdoor use may require a bright flashlight with a long burn time. Under such a scenario, flashlight size may not be important, which is preferable, as brighter flashlights with longer burn times tend to be larger in size. Nevertheless, there are other scenarios where ease of carry through the use of a smaller less bright flashlight is most important. Consequently, there are a wide variety of flashlights available, each designed to satisfy a different scenario. Unfortunately, this necessitates the purchase as well as the transport of many different flashlights. Accordingly, a flashlight that is bright, provides suitable burn time, and is modular to satisfy different scenarios would be desirable.

SUMMARY OF THE INVENTION

In accordance with the present invention, a flashlight is modular in that the flashlight includes a flashlight head assembly adapted to operate with either one battery or two batteries. In the one battery configuration, the flashlight head assembly connects with a body adapted to receive a battery therein. Activation of a switch assembly disposed in the body delivers power from the battery to the flashlight head assembly. In the two battery configuration, an extension unit adapted to receive a battery therein connects to the body and the flashlight head assembly connects to the extension unit. Activation of the switch assembly delivers power from the two batteries to the flashlight head assembly.

The flashlight head assembly includes an LED driver circuit that drives an LED of the flashlight head assembly. The LED driver circuit includes a voltage buck/boost that provides regulated voltage from the one battery or two batteries to an LED driver. The LED driver circuit further includes a voltage reference circuit that monitors incoming voltage to the buck/boost and prevents damage to the LED driver circuit by limiting the incoming voltage to a preset value. The LED driver circuit still further includes a current monitor/regulator that maintains a constant current in the LED independent of the voltage applied to the buck/boost.

DETAILED DESCRIPTION OF THE PREFERRED EMBODIMENT

Figure 1:
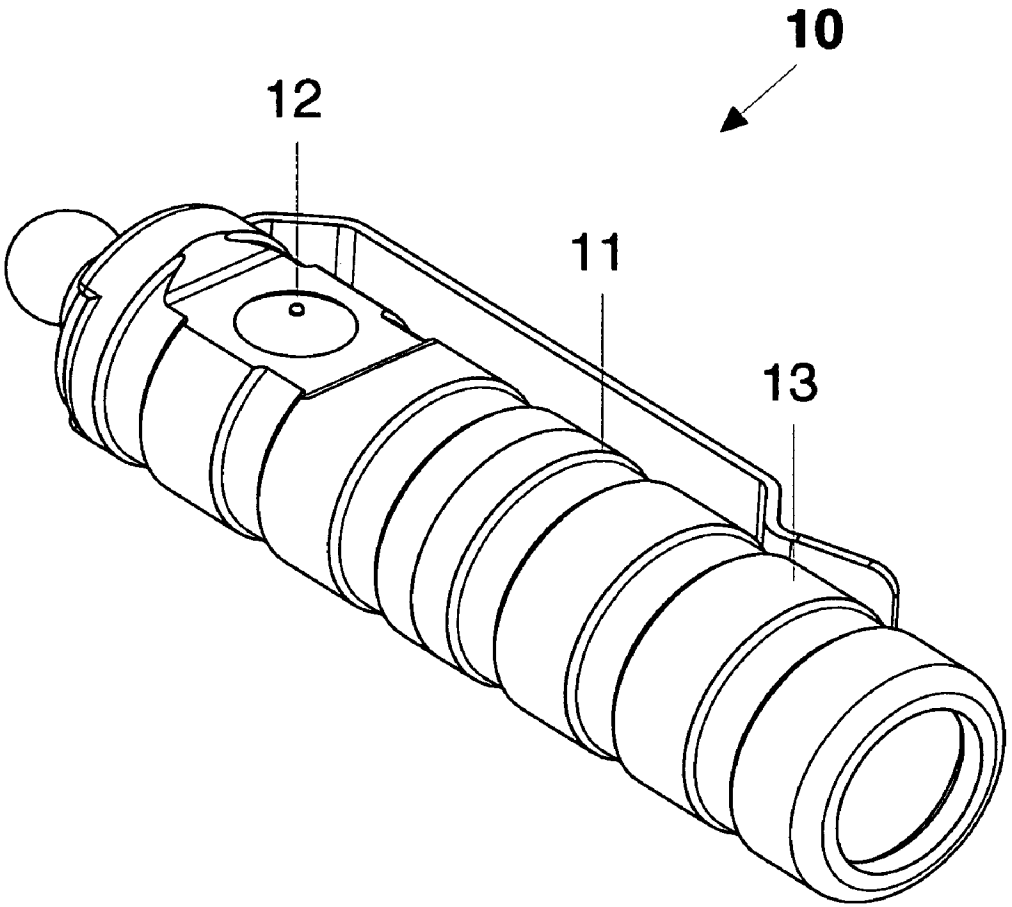
FIG. 1 is a perspective view illustrating a first configuration of a flashlight according to a preferred embodiment.
Figure 2:
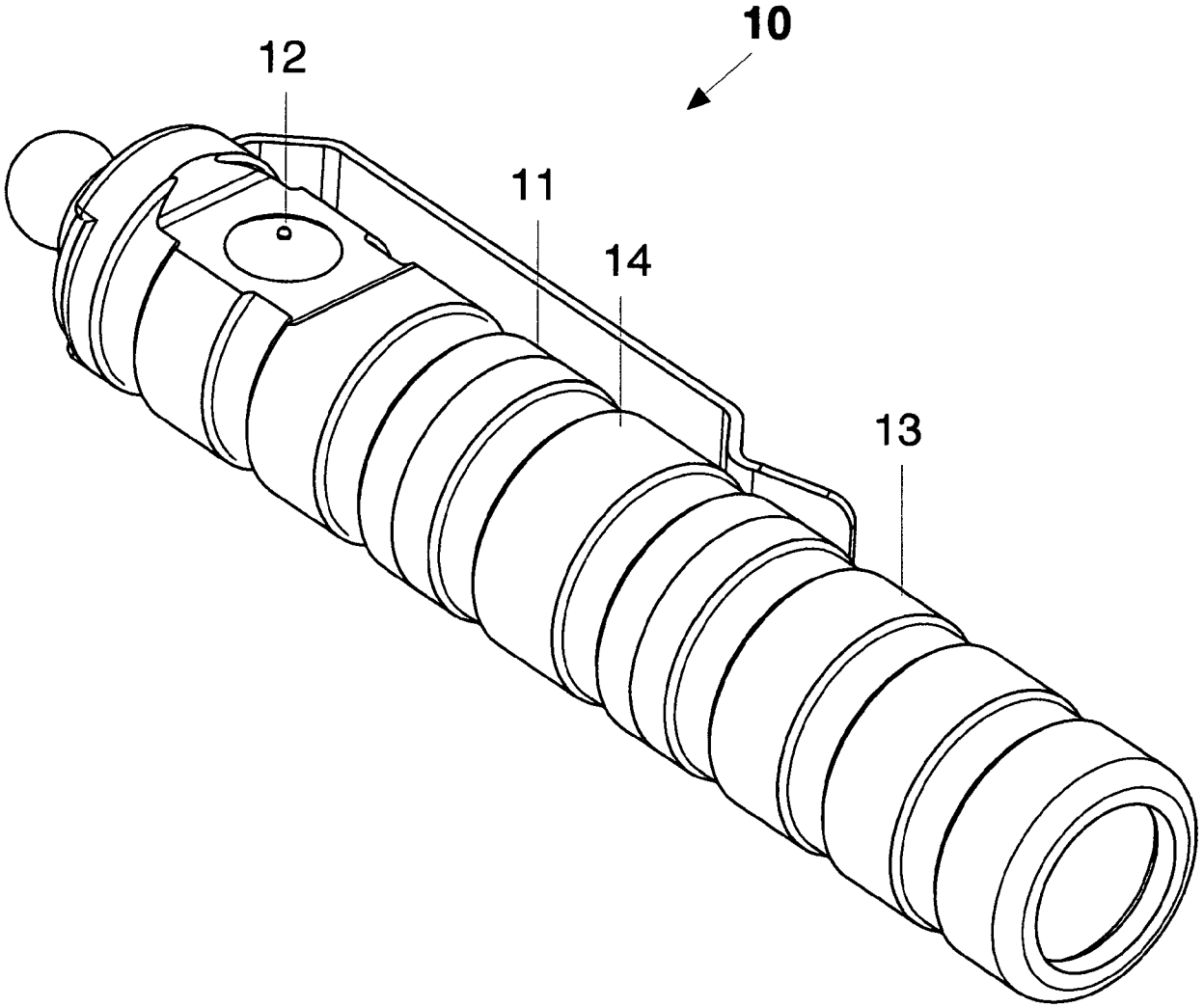
FIG. 2 is a perspective view illustrating a second configuration of a flashlight according to a preferred embodiment.

FIG. 1 illustrates a flashlight 10 in a first configuration that utilizes a single battery as a power source. The flashlight 10 in the first configuration includes a body 11, a switch assembly 12 disposed in the body 11, and a flashlight head assembly 13 coupled with the body 11. FIG. 2 illustrates the flashlight 10 in a second configuration that utilizes two batteries as a power source. The flashlight 10 in the second configuration includes the body 11, the switch assembly 12 disposed in the body 11, an extension unit 14 coupled with the body 11, and the flashlight head assembly 13 coupled with the extension unit 14.

Figure 3:
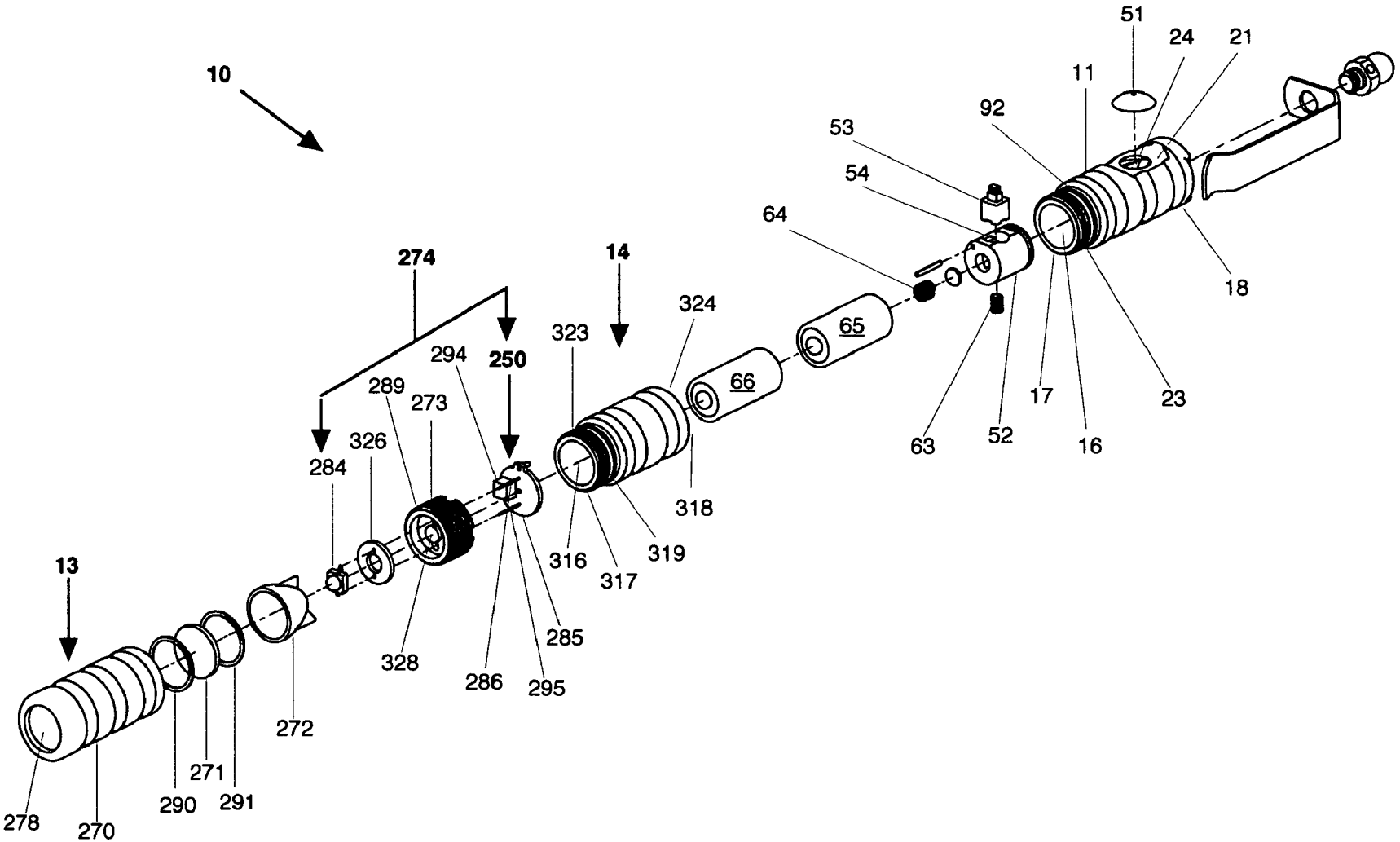
FIG. 3 is an exploded view illustrating the first and second configurations of the flashlight according to the preferred embodiment.
Figure 4:
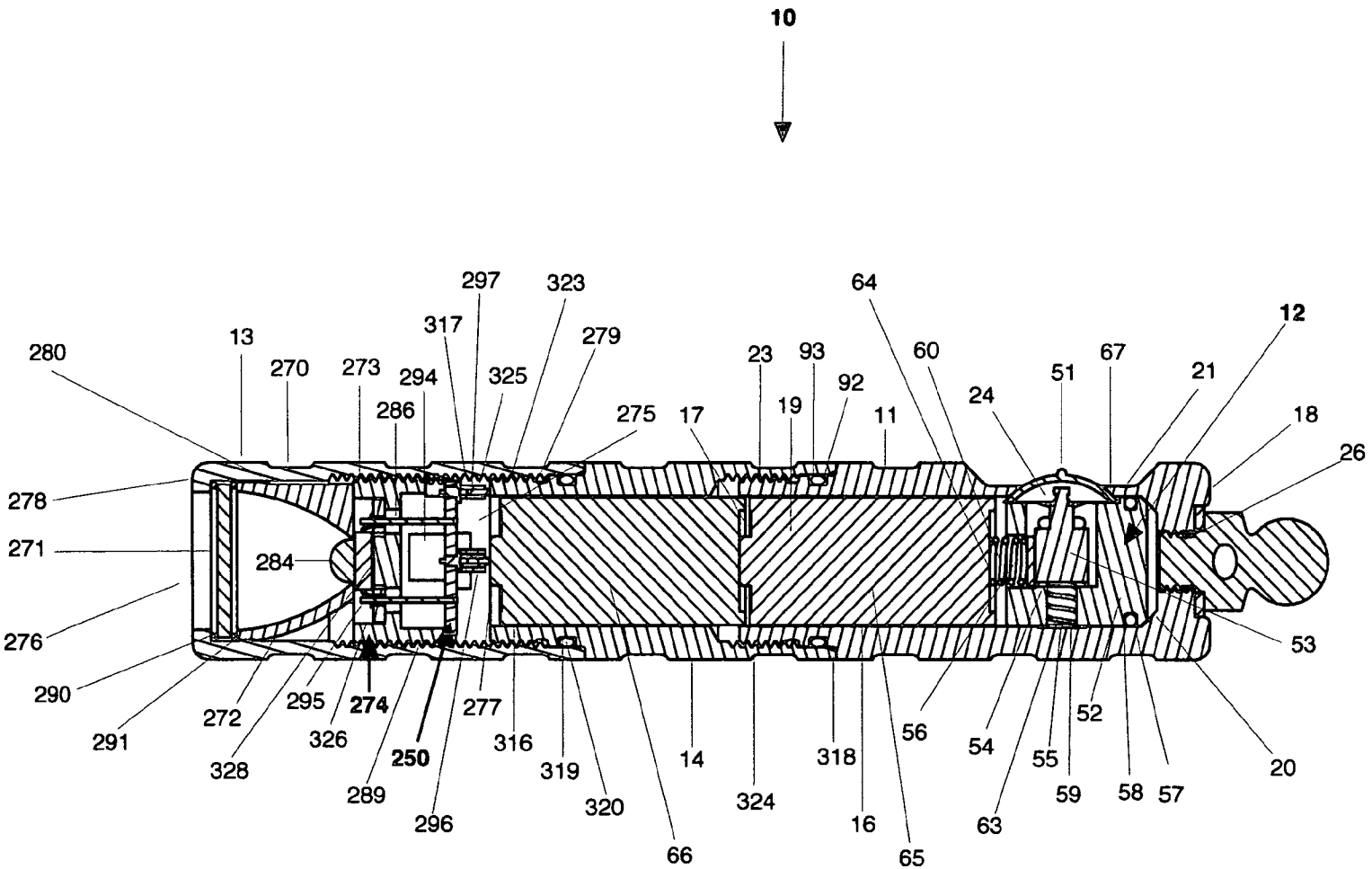
FIG. 4 is a cross-sectional view illustrating the second configurations of the flashlight according to the preferred embodiment.
Figure 6:
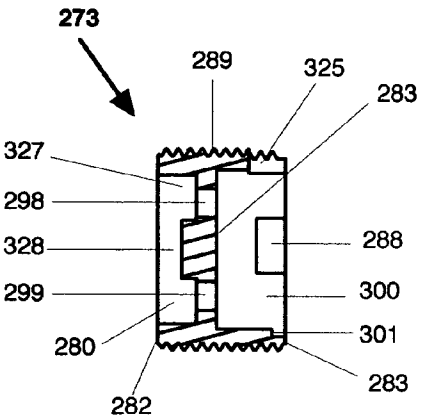
FIG. 6 is a cross-sectional view illustrating a heat sink for the flashlight head assembly.
Figure 8:
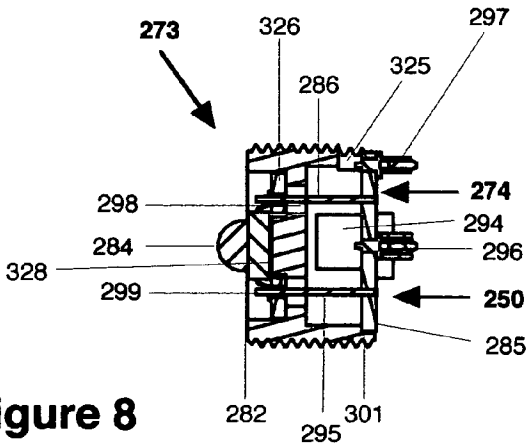
FIG. 8 is a cross-sectional view illustrating a heat sink and an LED assembly for the flashlight head assembly.
Figure 5:
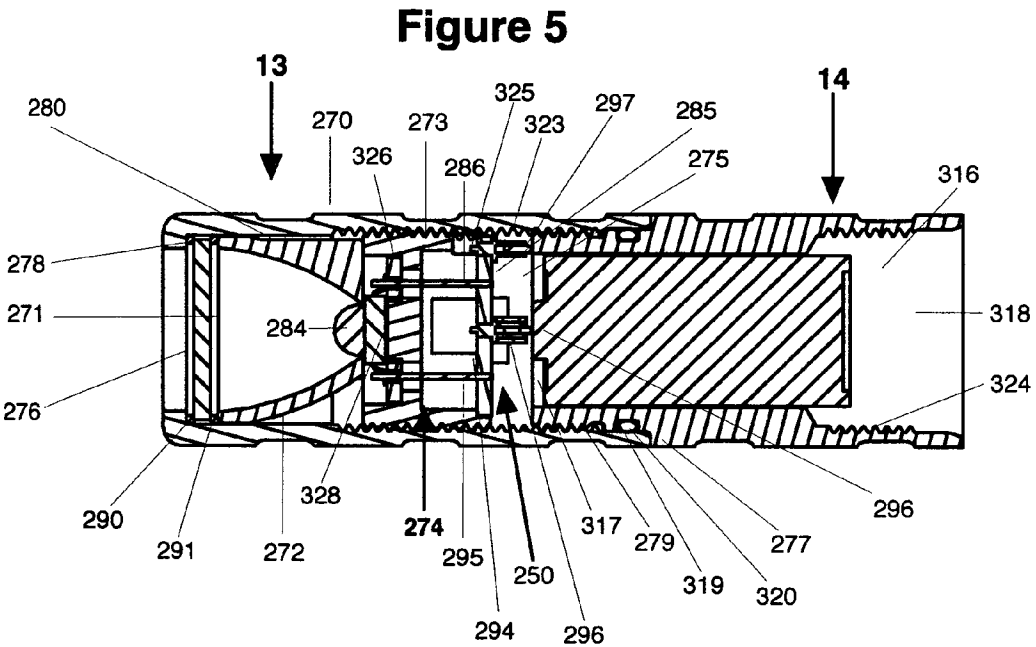
FIG. 5 is a cross-sectional view illustrating a flashlight head assembly according to the preferred embodiment.
Figure 7:
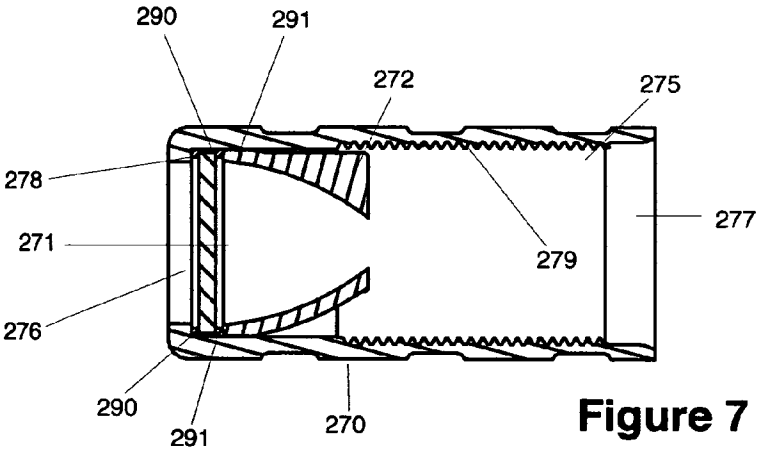
FIG. 7 is a cross-sectional view illustrating a flashlight head for the flashlight head assembly.
Figure 10:
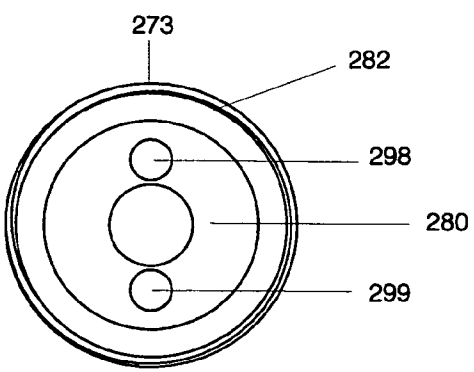
FIG. 10 is a front view illustrating a heat sink for the flashlight head assembly.
Figure 9:
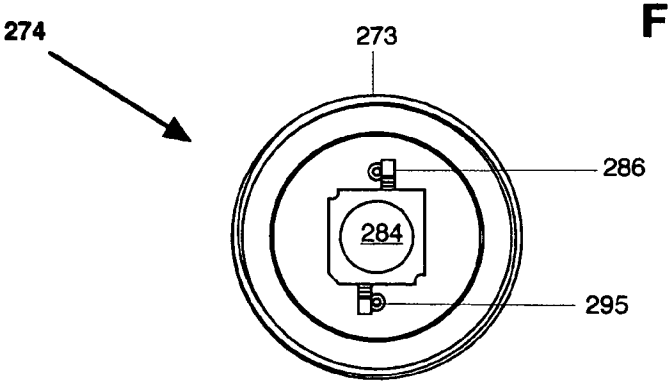
FIG. 9 is a front view illustrating an LED assembly and heat sink for the flashlight head assembly.
Figure 12:
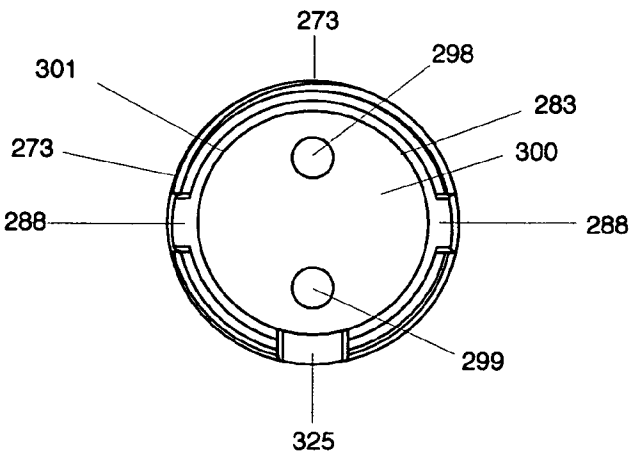
FIG. 12 is a rear view illustrating a heat sink for the flashlight head assembly.
Figure 11:
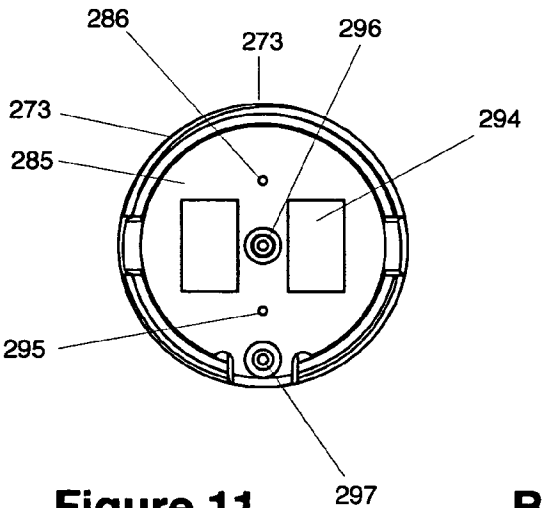
FIG. 11 is a rear view illustrating an LED assembly and a heat sink for the flashlight head assembly.
Figure 13:
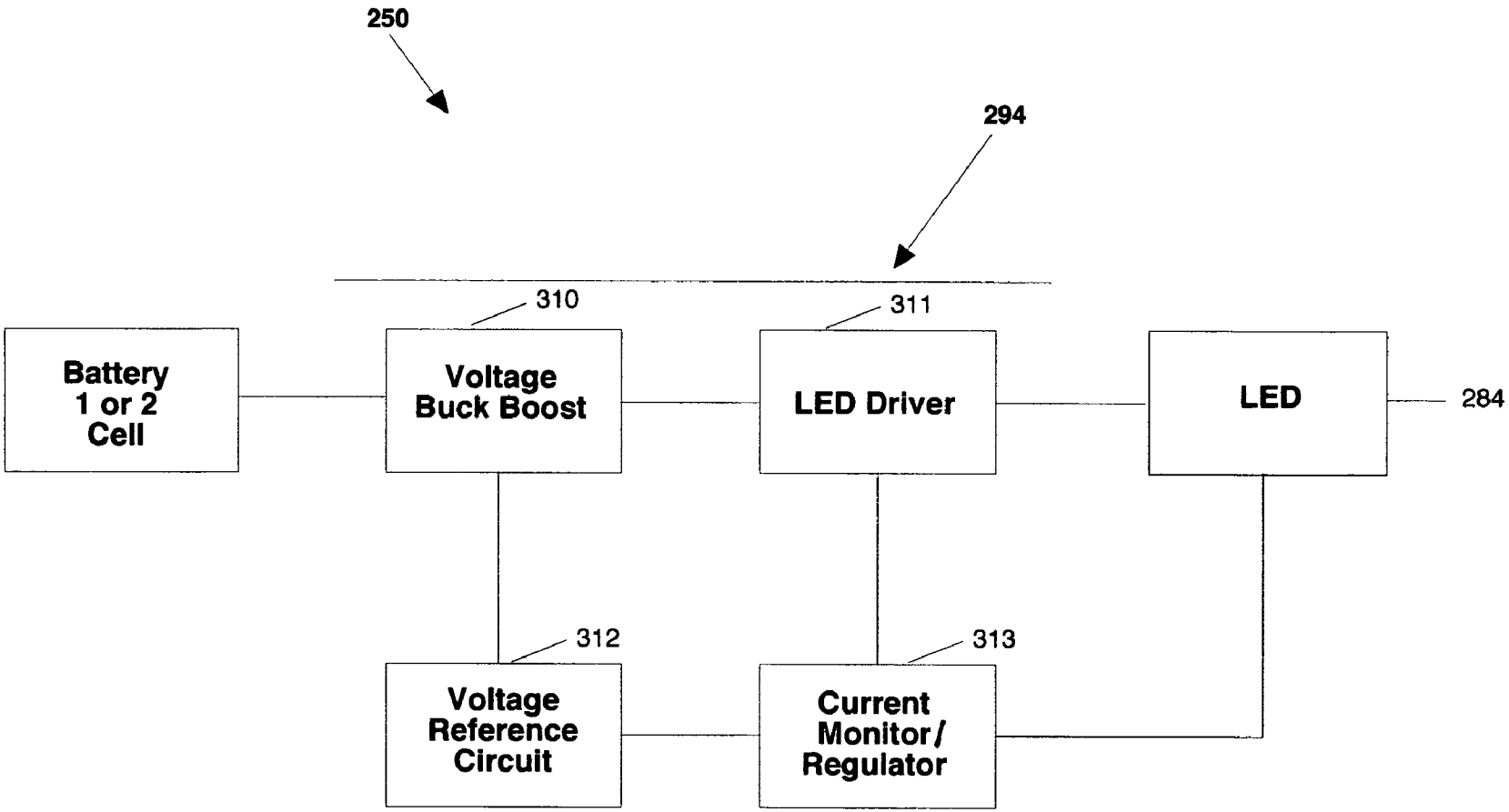
FIG. 13 is a block diagram illustrating an LED driver circuit for the flashlight head assembly.

Referring to FIGS. 3 and 4, the body 11 includes a bore 16 that begins at a first open end 17 of the body 11 and ends at a second closed end 18 of the body 11. The bore 16 provides the body 11 with a battery compartment 19 and a switch assembly compartment 20. The battery compartment 19 is adapted to receive one battery. The first end 17 of the body 11 includes threads 23 that facilitate securing of the flashlight head assembly 13 onto the body 11 in a position aligned with the axis of the body 11. Alternatively, the threads 23 that facilitate securing of the extension unit 14 onto the body 11 in a position aligned with the axis of the body 11. The first end 17 of the body 11 further includes a groove 92 that receives an o-ring 93 therein. The o-ring 93 provides a fluid tight seal between the body 11 and the flashlight head assembly 13 or the extension unit 14. The body 11 further includes a base 21 and a switch aperture 24 at the base 21. The base 21 provides a planar surface on the body 11 for the switch assembly 12.

A hitch ball furnishes the flashlight 10 with a striking implement at the second end 18 of the body 11, which, illustratively, may be employed to break an automobile window during an emergency situation. The second end 18 includes a threaded aperture 26 that receives the hitch ball therein. The hitch ball includes a threaded bolt portion that engages the threaded aperture 26 to secure the hitch ball to the body. The hitch ball includes an aperture therethrough that permits attachment of a lanyard to the flashlight 10.

While the threaded aperture 26 primarily functions to facilitate securing of the hitch ball to the flashlight 10, those of ordinary skill in the art will recognize that other suitable objects may be secured to the flashlight 10. Illustratively, a baton may be secured to the flashlight 10. The baton includes a threaded bolt portion that engages the threaded aperture 26 to secure the baton to the body 11, thereby providing the flashlight 10 with a self-defense baton feature. The baton may include a threaded aperture that is engaged by the threaded bolt portion of the hitch ball to permit the securing of the hitch ball to the baton. Still further, a firearm, such as a shotgun, including a threaded bolt portion would permit the securing of the flashlight 10 thereto.

The switch assembly 12 includes a switch cap 51, a switch housing 52, and a switch 53. The switch cap 51 includes a convex shape and is constructed from any suitable water resistant rubberized or plasticized material using well-known manufacturing techniques, such as vacuum forming or injection molding. The switch 53 is a push-button type switch of well-known design and is available from Switch Channel, P.O. Box 31557, Los Angeles, Calif. 90031.

The switch housing 52 is cylindrical in shape and has a diameter that permits frictional engagement with the inner walls of the switch assembly compartment 20. The switch housing 52 provides a support platform for the switch 53 and is constructed from any suitable water resistant plastics material using well-known manufacturing techniques, such as machining or injection molding. The switch housing 52 includes a cavity 54, contact apertures 55 and 56, and a groove 57 that receives therein an o-ring 58. The switch 53 seats within the cavity 54 of the switch housing 52 and is held in place using any suitable means such as a rod inserted into the switch housing that abuts the switch, friction, or an adhesive. A terminal 59 fits through the contact aperture 55 and electrically connects via a conductive disc or soldering to a ground contact of the switch 53, thereby forming a ground terminal 63 for the switch assembly 12. Similarly, a terminal 60 fits through the contact aperture 56 and electrically connects via a conductive disc or soldering to a positive contact of the switch 53, thereby forming a positive terminal 64 for the switch assembly 12.

Once the switch 53 has been seated within and electrically connected to the switch housing 52, the switch housing 52 inserts into the switch assembly compartment 20 through the first open end 17 of the body 11. The switch housing 52 inserts into the switch assembly compartment 20 until the switch housing 52 abuts the second closed end 18 of the body 11. The abutment of the switch housing 52 with the second closed end 18 of the body 11 and the o-ring 58 provide a fluid tight seal at the second end 18 of the flashlight 10. Further, when the switch housing 52 abuts the second closed end 18 of the body 11, the switch housing 52 locates the switch 53 such that the switch 53 protrudes through the switch aperture 24 to permit activation of the switch 53 by a user of the flashlight 10. With the switch housing 52 properly located within the switch assembly compartment 20 and the switch 53 protruding through the switch aperture 24, the switch cap 51 fits over the switch 53 and the switch aperture 24 and is frictionally held in place by a lip 67 of the switch aperture 24 in order to provide the switch assembly with a fluid tight seal. In addition, the positive terminal 64 protrudes into the battery compartment 19 to engage battery 65, and the ground terminal 63 engages the switch assembly compartment 20 to complete a circuit that powers the flashlight head assembly 13 upon the activation of the switch 53 by a user.

The switch assembly 12 is located at the cylindrical portion of the body 11 adjacent the second closed end 18 of the body 11 but not on the second closed end of the body 11 in order to permit grasping of the flashlight 10 with either an overhand grip as used by law enforcement or an underhand grip. In particular, the switch assembly 12 may be accessed by the thumb of a user from either an overhand grip or an underhand grip without the necessity of changing the position of the thumb relative to the switch assembly 12. Moreover, the base 21 on the cylindrical portion of the body 11 seats the thumb over the switch assembly 12. The location of the switch assembly 12 on the cylindrical portion of the body 11 accordingly improves over flashlights with switches located at the rear thereof, near the head thereof, or on the head thereof because such switch locations do not permit ease of use with both an overhand grip as used by law enforcement and an underhand grip.

Referring to FIGS. 5-13, a flashlight head assembly 13 is adapted for use with the flashlight 10 and includes a flashlight head 270, a lens 271, a reflector 272, a heat sink 273, and an LED assembly 274. The flashlight head 270 includes a bore 275 therethrough beginning at a first end 276 and ending at a second end 277. The flashlight head 270 at the first end 276 includes a lip 278 that provides a surface for retaining the lens 271 within the flashlight head 270. The flashlight head 270 at the second end 277 includes threads 279 internal thereto that maintain the heat sink 273 within the flashlight head 270 as well as facilitate the securing of the flashlight head assembly 13 onto the body 11 or the extension unit 14.

The LED assembly 274 includes a printed circuit board 285, an insulator 326, an LED 284 electrically coupled with the printed circuit board 285 via an input post 286 and a return post 295 electrically connected to the printed circuit board 285, and micro-electronic circuitry 294 mounted onto the printed circuit board 285 such that the micro-electronic circuitry 294 and the printed circuit board 285 form an LED driver circuit 250. The micro-electronic circuitry 294 is electrically coupled with the LED 284 through the printed circuit board 285 to control the delivery of power to the LED 284. The LED assembly 274 further includes a positive input terminal 296 connected with the printed circuit board 285 at a central portion thereof. The positive input terminal 296 is electrically coupled with the micro-electronic circuitry 294 via the printed circuit board 285. The LED assembly 274 still further includes a ground terminal 297 connected with the printed circuit board 285 at an edge thereof. The ground terminal 297 resides in a slot 325 of the heat sink 273 and is electrically coupled with the micro-electronic circuitry 294 via the printed circuit board 285.

The current level necessary to operate the LED 284 is predetermined and the same for the first configuration and the second configuration of the flashlight 10. Consequently, the LED driver circuit 250 may be the same for the first configuration and the second configuration of the flashlight 10 because the micro-electronic circuitry 294 delivers the current level necessary to operate the LED 284 regardless of whether there is one battery as per the first configuration applying a first voltage and operating the LED 284 at a first output level or two batteries as per the second configuration applying a second voltage and operating the LED 284 at a second output level. The micro-electronic circuitry 294 as per FIG. 13 includes a voltage buck/boost 310, an LED driver 311, a voltage reference circuit 312, and a current monitor/regulator 313. The voltage buck/boost 310 modulates the voltage delivered from the battery or batteries to ensure the voltage applied to the LED 284 by the LED driver 311 is sufficient to operate the LED 284. The LED driver drives the LED 284, and, in this preferred embodiment, the LED driver is any suitable transistor such as a MOSFET. The voltage reference circuit 312 monitors the incoming voltage to the buck/boost 310 to ensure the incoming voltage does not exceed a high threshold established for the delivery of voltage to the buck/boost 310. The current monitor/regulator 313 controls the LED driver 311 such that the LED driver 311 delivers a constant current to the LED 284 independent of the voltage applied by the buck/boost 310.

The heat sink 273, which is constructed from any suitable conductive material, such as aluminum, secures the LED assembly 274 within the flashlight head 270 and further delivers heat generated by the LED assembly 274 to the flashlight head 270 and the body 11. The heat sink 273 includes threads 289 on an exterior portion thereof that engage the threads 279 of the flashlight head 270 to secure the heat sink 273 within the flashlight head 270. The heat sink 273 includes a slot 288 that may be engaged by a tool such as needle nose pliers to insert the heat sink 273 into the flashlight head 270. A first cavity 280 at a first end 282 of the heat sink 273 provides a space for the mounting of the LED 284 to the heat sink 273. Within the first cavity 280, the heat sink 273 includes a raised portion 328 that seats the LED 284. The inclusion of the raised portion 328 within the first cavity 280 creates a groove 327 that receives the insulator 326 therein. Similarly, a second cavity 300 at a second end 283 of the heat sink 273 provides a space for the mounting of the printed circuit board 285 within the heat sink 273. A first aperture 298 and a second aperture 299 pass from the first cavity 280 to the second cavity 300 to permit a respective one of the input post 286 and the return post 295 of the LED 284 to extend into the second cavity 300. The heat sink 273 is countersunk at the second end 283 thereby creating a detent 301 that seats the printed circuit board 285 within the heat sink 273.

The LED assembly 274 is built into the heat sink 273, which enhances the ability of the heat sink 273 to dissipate heat generated by the LED assembly 274. In particular, once the LED driver circuit 250 is constructed, including the electrical connection of the input post 286, the return post 295, the positive input terminal 296, and the ground terminal 297 to the printed circuit board 285, the printed circuit board 285 with the micro-electronic circuitry 294 facing the second cavity 300 is inserted into the second cavity 300 until the edge on the printed circuit board 285 abuts the detent 301. In addition, and upon insertion of the printed circuit board 285 into the second cavity 300, the input post 286 passes through the first aperture 298 and the return post 295 passes through the second aperture 299 such that the input post 286 and the return post 295 extend into the first cavity 280. The insulator 326 is placed within the groove 327 to insulate the LED 284 from the heat sink 273. Moreover, the insulator 326 includes a first aperture that receives the input post 286 therethrough and a second aperture that receives the return post 295 therethrough such that the insulator 326 aligns the input post 286 and the return post 295 within the first cavity 280. A heat sink grease, which thermally connects the LED 284 to the heat sink 273, is applied to the raised portion 328 within the first cavity 280 followed by the placement of the LED 284 onto the raised portion 328. The LED 284 fits within the first cavity 280 and resides atop the raised portion 328 such that only the lens portion of the LED 284 extends above the first end 282 of the heat sink 274. After placement of the LED 284 within the first cavity 280, the anode terminal of the LED 284 is electrically connected with the input post 286 and the cathode terminal of the LED 284 is electrically connected with the return post 295, thereby securing the LED assembly 274 within the heat sink 273.

Construction of the flashlight head assembly 13 begins with the insertion of an o-ring 290 into the flashlight head 270 until the o-ring 290 abuts the lip 278 of the flashlight head 270. The lens 271 inserts into the flashlight head 270 until the lens 271 abuts the o-ring 290. An o-ring 291 then inserts into the flashlight head 270 until the o-ring 291 abuts the lens 271. After insertion of the o-ring 291, the reflector 272 inserts into the flashlight head 270 until the reflector 272 abuts the o-ring 291. The O-rings 290 and 291 create a fluid tight seal at the first end 276 of the flashlight head 270 and further protect from damage the edges of both the lens 271 and the reflector 272. The heat sink 273, which includes the LED assembly 274 built therein as previously described, screws within the flashlight housing 270 until the first end 282 of the heat sink 273 abuts the reflector 272. In that position, the lens of the LED 284 protrudes into the reflector 272, which directs the light produced from the LED 284 through the lens 271 and from the flashlight head 270. Once construction of the flashlight head assembly 13 is completed, the flashlight head assembly 13 may be secured to the body 11 to produce the flashlight 10 according to the first configuration or to the extension unit 14 to produce the flashlight 10 according to the second configuration. It should be understood that securing the flashlight head assembly 13 to the body 11 or to the extension unit 14 facilitates abutment of the positive input terminal 296 with the battery 65 or battery 66 and the ground terminal 297 with the leading edge of the body 11 or the extension unit, thereby providing an electrical connection between the flashlight head assembly 13 and the body 11 or the extension unit 14. Consequently, activation of the switch assembly 12 delivers power to the LED assembly 274 via a circuit encompassing the battery or the batteries of the flashlight 10, the positive input terminal 296, the micro-electronic circuitry 294, the LED 284, the ground terminal 297, possibly the extension unit 14, the body 11, and the switch assembly 12.

An advantage in the design of the flashlight head assembly 13 is that the LED assembly 274 is built within the heat sink 273 such that the heat sink 273 substantially completely surrounds the LED 284, the printed circuit board 285, and the micro-electronic circuitry 294. In particular, substantially completely surrounding the LED assembly 274 with the heat sink 273 maximizes surface area contact between the heat sink 273 and the LED assembly 274, thereby enhancing the exchange of heat from the LED assembly 274 to the heat sink 273. Further, substantially completely surrounding the LED assembly 274 with the heat sink 273 maximizes the mass of conductive material about the LED assembly 274, thereby enhancing the exchange of heat from the LED assembly 274 to the heat sink 273. A further advantage in the design of the flashlight head assembly 13A is that the heat sink 273 contacts the flashlight head 270, which essentially transforms the entire flashlight head assembly 13 into a heat sink for the LED assembly 274. Consequently, when the flashlight head assembly 13 is secured to the body 11, the body 11 acts as a heat sink to further enhance the dissipation of heat generated by the LED assembly 274.

The reflector 272 may be constructed of a plastics material with a reflective coating that directs the light produced from the LED 284 through the lens 271 and from the flashlight head 270. The reflector 272 in the third embodiment is cylindrically shaped, which enhances the strength thereof. Cost considerations may be the driving factor in selecting a reflector constructed from a plastics material. Alternatively, the reflector 272 may be constructed from any suitable conductive material, such as aluminum, which is polished to provide a reflective surface that directs the light produced from the LED 284 through the lens 271 and from the flashlight head 270. The reflector 272 may be constructed from conductive material when it is desired to enhance the dissipation of heat generated by the LED assembly 274. Particularly, a reflector 272 constructed from conductive material abuts the printed circuit board 285 of the LED assembly 274, thereby rejecting heat generated on the printed circuit board 285 by the micro-electronic circuitry 294. The contact of a reflector 272 constructed from conductive material with the printed circuit board 285 of the LED assembly 274 effectively adds an additional heat sink, thereby increasing the rejection of heat generated by the LED assembly 274. Moreover, the reflector 272 is cylindrically shaped, which enhances the strength of thereof as well as increases the surface area available for the rejection of heat.

The flashlight 10 in the first configuration with the flashlight head assembly 13 secured to the body 11 provides a user with a compact flashlight that is easily carried. The flashlight 10 in the first configuration includes one battery and provides a user with a bright light and adequate burn time for most situations.

In a situation where a user desires a brighter light and a longer burn time, the user simply removes the flashlight head assembly 13 from the body 11, secures the extension unit 14 to the body 11, places a second battery within the extension unit 14, and secures the flashlight head assembly 13 to the extension unit 14. The extension unit 14 as shown in FIGS. 3 and 4 includes a first end 317, a second end 318, and a bore 316 therethrough. The extension unit 14 is sized such that a battery may be placed therein, which provides the flashlight 10 with a second battery and forms the second configuration of the flashlight 10. The second end 318 includes threads 324 therein that facilitate the securing of the extension unit 14 to the body 11 in a position aligned with the axis of the body 11. The first end 317 includes threads 323 that facilitate the securing of the flashlight head assembly 13 to the extension unit 14 in a position aligned with the axis of the body 11. The first end 317 of the body 11 further includes a groove 319 that receives an o-ring 320 therein. The o-ring provides a fluid tight seal between the extension unit 14 and the flashlight head assembly 13.

While the flashlight 10 has been described with two configurations employing either one or two batteries, those of ordinary skill in the art should recognize that, in light of the foregoing disclosure, other configurations may include additional batteries creating a flashlight 10 with a flashlight head assembly 13 operable with three or more batteries. Moreover, although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description; rather, it is defined only by the claims that follow.

We claim:

1. A flashlight, comprising:

a switch assembly;

a body including a first end and a second, wherein the switch assembly is disposed within the body at the second end, further wherein the body is adapted to receive a first number of batteries therein, the first number of batteries being at least one;

an extension unit securable to the body at the first end, the extension unit adapted to receive at least one battery therein, thereby providing the flashlight with a second number of batteries, the second number of batteries being at least one greater than the first number of batteries; and a flashlight head assembly securable to the body at the first end or to the extension unit, the flashlight head assembly comprising an LED and an LED driver circuit adapted to deliver a predetermined current through the LED from either the first number of batteries or the second number of batteries, wherein, when the flashlight head assembly is secured to the body at the first end, the first number of batteries applies a first voltage to the LED driver circuit such that the LED driver circuit delivers the predetermined current through the LED and the LED operates at a first output level, further wherein, when the flashlight head assembly is secured to the extension unit, the second number of batteries applies a second voltage to the LED driver circuit such that the LED driver circuit delivers the predetermined current through the LED and the LED operates at a second output level.

2. The flashlight according to claim 1, wherein the LED driver circuit, comprises:

an LED driver that drives the LED of the flashlight head assembly;

a voltage buck/boost that modulates the voltage delivered from the first number of batteries or the second number of batteries to maintain a voltage for the LED driver sufficient to operate the LED;

a voltage reference circuit that monitors voltage delivered to the buck/boost; and a current monitor/regulator that controls the LED driver to maintain the constant current through the LED.

3. The flashlight according to claim 1, wherein the flashlight head assembly further comprises:

a flashlight head including a first end and a second end securable to the body or the extension unit;

a lens disposed in the flashlight head at the first end;

a reflector disposed in the flashlight head adjacent the lens;

a heat sink disposed in the flashlight head adjacent the reflector; and an LED assembly comprised of the LED and the LED driver circuit coupled with the heat sink.

4. The flashlight according to claim 3, wherein the LED driver circuit, further comprises:

an LED driver that drives the LED of the flashlight head assembly;

a voltage buck/boost that modulates the voltage delivered from the first number of batteries or the second number of batteries to maintain a voltage for the LED driver sufficient to operate the LED;

a voltage reference circuit that monitors voltage delivered to the buck/boost; and a current monitor/regulator that controls the LED driver to maintain the constant current through the LED.

5. The flashlight according to claim 3, wherein the LED and the LED driver circuit reside substantially completely within the heat sink.

6. The flashlight according to claim 3, wherein:

the LED is disposed within a first end of the heat sink; and the LED driver circuit is disposed within a second end of the heat sink.

7. The flashlight according to claim 3, wherein the LED driver circuit comprises micro-electronic circuitry mounted on a printed circuit board.

8. The flashlight according to claim 7, wherein the LED assembly further comprises:

an input post electrically connected with the printed circuit board; and a return post electrically connected with the printed circuit board.

9. The flashlight according to claim 8, wherein:

an anode terminal of the LED electrically connects with the input post; and a cathode terminal of the LED electrically connects with the return post.

10. The flashlight according to claim 7, wherein the LED assembly further comprises:

an input terminal electrically connected with the printed circuit board; and a return terminal electrically connected with the printed circuit board.

11. The flashlight according to claim 8, wherein the heat sink includes:

a first cavity at a first end;

a second cavity at a second end; and first and second apertures between the first cavity and the second cavity.

12. The flashlight according to claim 11, wherein:

the printed circuit board with the micro-electronic circuitry mounted thereon is disposed within the second cavity of the heat sink such that the input post extends into the first cavity through the first aperture and the return post extends into the first cavity through the second aperture; and the LED is disposed within the first cavity of the heat sink such that an anode terminal of the LED electrically connects with the input post and a cathode terminal of the LED electrically connects with the return post.

13. The flashlight according to claim 12, wherein the LED assembly further comprises an insulator disposed in the first cavity for insulating the LED.

14. The flashlight according to claim 12, wherein the LED assembly further comprises:

an input terminal electrically connected with the printed circuit board; and a return terminal electrically connected with the printed circuit board.

15. A flashlight, comprising:

a body adapted to receive a first number of batteries therein, the first number of batteries being at least one;

an extension unit securable to the body, the extension unit adapted to receive at least one battery therein, thereby providing the flashlight with a second number of batteries, the second number of batteries being at least one greater than the first number of batteries;

a flashlight head assembly securable to the body or to the extension unit, the flashlight head assembly comprising an LED and an LED driver circuit adapted to deliver a predetermined current through the LED from either the first number of batteries or the second number of batteries, wherein, when the flashlight head assembly is secured to the body, the first number of batteries applies a first voltage to the LED driver circuit such that the LED driver circuit delivers the predetermined current through the LED and the LED operates at a first output level, further wherein, when the flashlight head assembly is secured to the extension unit, the second number of batteries applies a second voltage to the LED driver circuit such that the LED driver circuit delivers the predetermined current through the LED and the LED operates at a second output level; and a switch assembly disposed in the body, wherein the switch assembly electrically connects with the flashlight head assembly to control the delivery of power to the flashlight head assembly.

16. The flashlight according to claim 15, wherein the LED driver circuit, comprises:

an LED driver that drives the LED of the flashlight head assembly;

a voltage buck/boost that modulates the voltage delivered from the first number of batteries or the second number of batteries to maintain a voltage for the LED driver sufficient to operate the LED;

a voltage reference circuit that monitors voltage delivered to the buck/boost; and a current monitor/regulator that controls the LED driver to maintain the constant current through the LED.

17. The flashlight according to claim 15, wherein the flashlight head assembly further comprises:

a flashlight head including a first end and a second end securable to the body or the extension unit;

a lens disposed in the flashlight head at the first end;

a reflector disposed in the flashlight head adjacent the lens;

a heat sink disposed in the flashlight head adjacent the reflector; and an LED assembly comprised of the LED and the LED driver circuit coupled with the heat sink.

18. The flashlight according to claim 17, wherein the LED and the LED driver circuit reside substantially completely within the heat sink.

19. The flashlight according to claim 17, wherein:

the LED is disposed within a first end of the heat sink; and the LED driver circuit is disposed within a second end of the heat sink.

20. The flashlight according to claim 17, wherein the LED driver circuit comprises micro-electronic circuitry mounted on a printed circuit board.

21. The flashlight according to claim 20, wherein the LED assembly further comprises:

an input post electrically connected with the printed circuit board; and a return post electrically connected with the printed circuit board.

22. The flashlight according to claim 21, wherein:

an anode terminal of the LED electrically connects with the input post; and a cathode terminal of the LED electrically connects with the return post.

23. The flashlight according to claim 20, wherein the LED assembly further comprises:

an input terminal electrically connected with the printed circuit board; and a return terminal electrically connected with the printed circuit board.

24. The flashlight according to claim 21, wherein the heat sink includes:

a first cavity at a first end;

a second cavity at a second end; and first and second apertures between the first cavity and the second cavity.

25. The flashlight according to claim 24, wherein:

the printed circuit board with the micro-electronic circuitry mounted thereon is disposed within the second cavity of the heat sink such that the input post extends into the first cavity through the first aperture and the return post extends into the first cavity through the second aperture; and the LED is disposed within the first cavity of the heat sink such that an anode terminal of the LED electrically connects with the input post and a cathode terminal of the LED electrically connects with the return post.

26. The flashlight according to claim 25, wherein the LED assembly further comprises an insulator disposed in the first cavity for insulating the LED.

27. The flashlight according to claim 25, wherein the LED assembly further comprises:

an input terminal electrically connected with the printed circuit board; and a return terminal electrically connected with the printed circuit board.

* * * * *